US007211719B2

(12) United States Patent
Blake

(10) Patent No.: US 7,211,719 B2
(45) Date of Patent: May 1, 2007

(54) STRINGED INSTRUMENT

(76) Inventor: Jason D. Blake, 14 Dogwood Ct., Lake In The Hills, IL (US) 60156

( * ) Notice: Subject to any disclaimer, the term of this patent is extended or adjusted under 35 U.S.C. 154(b) by 0 days.

(21) Appl. No.: 11/169,524

(22) Filed: Jun. 29, 2005

(65) Prior Publication Data

US 2007/0000370 A1 Jan. 4, 2007

(51) Int. Cl.
*G10D 3/00* (2006.01)

(52) U.S. Cl. ..... 84/290; 84/267

(58) Field of Classification Search ..... 84/290, 84/267; D17/14, 15, 19, 20
See application file for complete search history.

(56) References Cited

U.S. PATENT DOCUMENTS

| | | | | |
|---|---|---|---|---|
| 474,120 | A | | 5/1892 | Ganss |
| 552,116 | A | | 12/1895 | Gaskins |
| D26,424 | S | | 12/1896 | Livermore |
| D28,300 | S | | 2/1898 | Knutsen |
| D32,088 | S | | 1/1900 | Kitchen |
| 767,023 | A | | 8/1904 | Turturro |
| 812,049 | A | | 2/1906 | Krueger |
| 964,660 | A | | 7/1910 | Laurian |
| D45,566 | S | | 4/1914 | Longobardi |
| 1,183,369 | A | | 5/1916 | Gardie |
| D52,539 | S | | 10/1918 | McVey |
| 1,684,467 | A | | 9/1928 | Boothe |
| 2,250,402 | A | | 7/1941 | Towell |
| 3,392,618 | A | | 7/1968 | Pelensky |
| 3,398,622 | A | | 8/1968 | Smith |
| 3,398,623 | A | | 8/1968 | Smith |
| D222,562 | S | | 11/1971 | Pelensky |
| D223,290 | S | * | 4/1972 | Wolfe ..... D17/14 |
| D224,566 | S | | 8/1972 | Pelensky |
| D224,567 | S | | 8/1972 | Pelensky |
| 3,739,072 | A | | 6/1973 | Smith |
| 3,785,239 | A | | 1/1974 | Smith |
| 3,858,480 | A | | 1/1975 | Schneider et al. |
| D256,026 | S | | 7/1980 | McCracken |
| 4,311,078 | A | | 1/1982 | Falgares |
| 4,339,981 | A | | 7/1982 | Smith |
| D277,292 | S | | 1/1985 | Leifhelt |
| 4,606,255 | A | | 8/1986 | Hayashi et al. |
| 4,616,550 | A | | 10/1986 | Lacroix et al. |
| D293,118 | S | | 12/1987 | Rose |
| 4,890,530 | A | | 1/1990 | Tatsumi |
| 4,919,029 | A | | 4/1990 | Excellente |
| D311,413 | S | | 10/1990 | Pakis |
| D314,783 | S | | 2/1991 | Vandenberg et al. |
| 5,251,526 | A | | 10/1993 | Hill |

(Continued)

OTHER PUBLICATIONS

American Musical Supply; Spring 2004; pp. 65 and 96.

(Continued)

*Primary Examiner*—Lincoln Donovan
*Assistant Examiner*—Jianchun Qin
(74) *Attorney, Agent, or Firm*—Banner & Witcoff, Ltd

(57) ABSTRACT

A stringed instrument, such as a guitar, includes an ergonomically configured body with a fret board extending therefrom. The body is configured with a S or Z-shaped cross-sectional ration transverse to the fret board to provide support for the arm of the instrumentalist as strings are fingered against the fret board and another sector which comprises a lap support instrument.

24 Claims, 6 Drawing Sheets

U.S. PATENT DOCUMENTS

| | | | | | |
|---|---|---|---|---|---|
| D351,181 | S | * | 10/1994 | Whiteside | D17/14 |
| 5,528,971 | A | | 6/1996 | Wood | |
| 5,637,820 | A | | 6/1997 | Wittman | |
| 5,852,249 | A | | 12/1998 | Steinberg et al. | |
| 5,994,633 | A | | 11/1999 | Norton | |
| D417,691 | S | | 12/1999 | Standish | |
| 6,034,308 | A | * | 3/2000 | Little | 84/291 |
| 6,573,439 | B2 | | 6/2003 | Wilson | |
| 6,608,247 | B2 | | 8/2003 | Bryan | |
| 6,649,818 | B2 | | 11/2003 | Bailey | |
| 6,657,112 | B1 | | 12/2003 | Zigounakis | |
| 6,667,431 | B1 | | 12/2003 | Norman | |
| 2002/0100357 | A1 | * | 8/2002 | Williams | 84/291 |
| 2004/0182221 | A1 | * | 9/2004 | Burrell | 84/291 |
| 2005/0132866 | A1 | * | 6/2005 | Sawhney et al. | 84/291 |

OTHER PUBLICATIONS

Sweetwater Progear 2004, Annual Gear Encylopedia; 25th Anniversary Edition vol. 60; p. 258.

* cited by examiner

FIG. 5
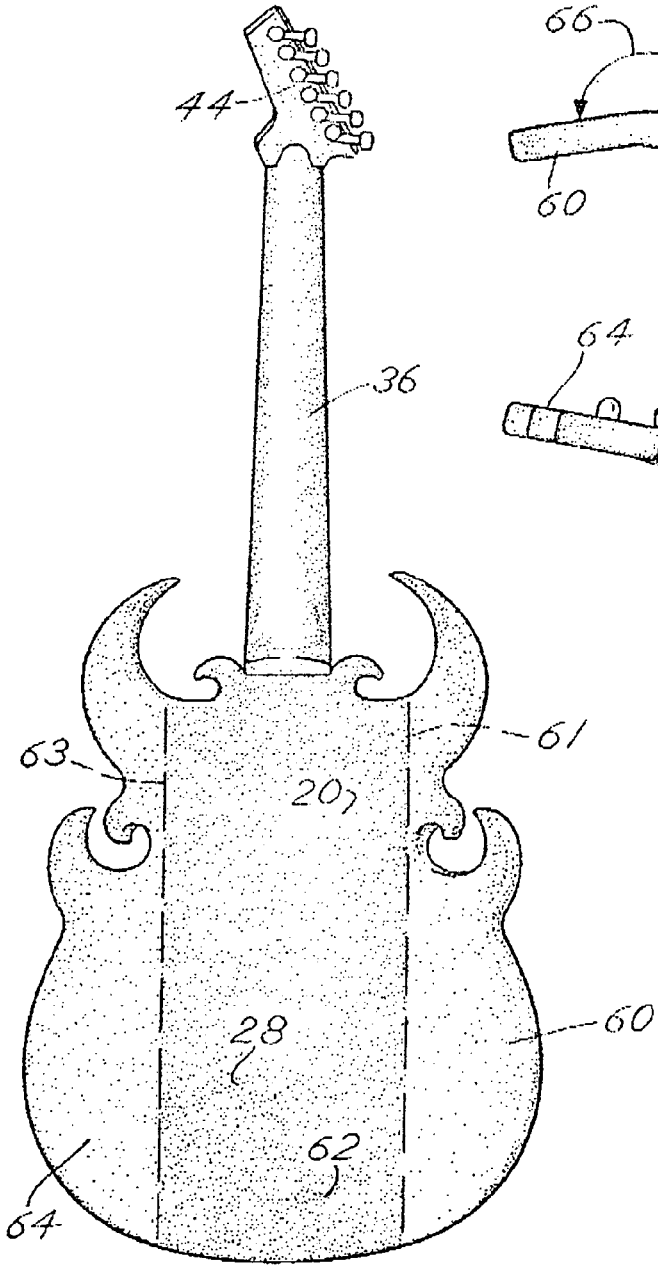
FIG. 6
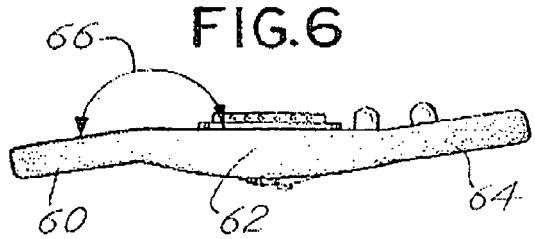
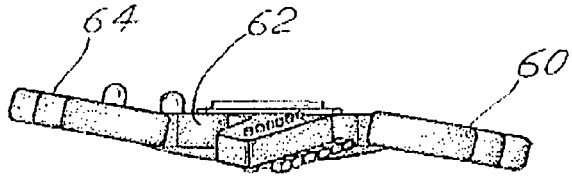
FIG. 7

86
87
79

86
92
87
88
84
82
80
79

86
87
92
88
79

FIG.12
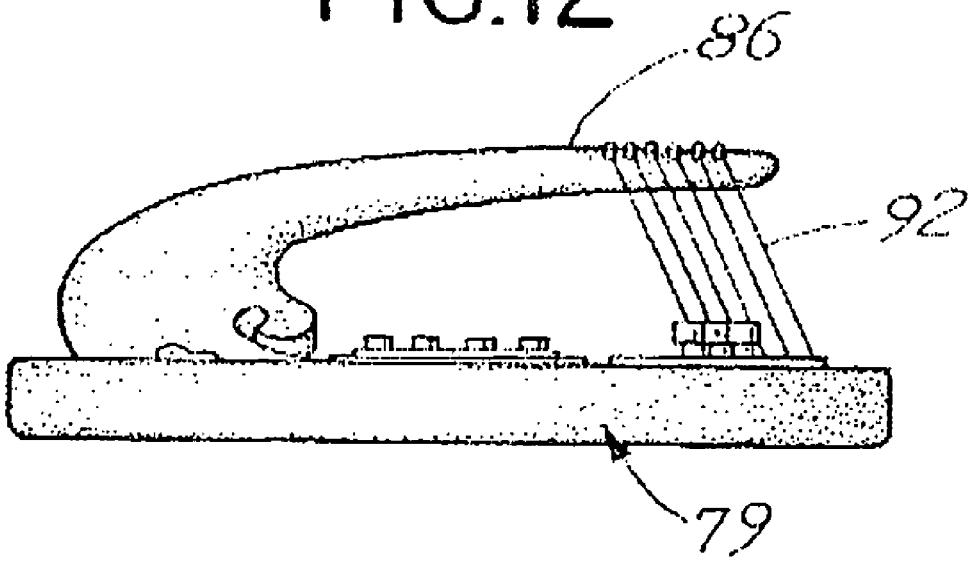
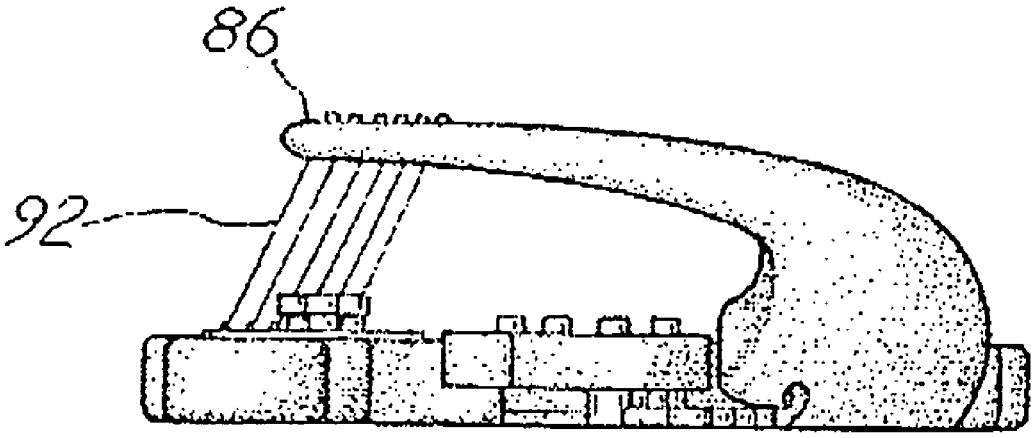
FIG.13

STRINGED INSTRUMENT

BACKGROUND OF THE INVENTION

In a principal aspect the present invention comprises a stringed instrument, such as a guitar, having an ergonomic design to facilitate comfort when the instrument is being played. The construction is especially applicable to an acoustic instrument.

Stringed instruments have an extremely long and varied history. In ancient times a lyre constituted a type of stringed instrument wherein the strings were generally mounted in a parallel array on a frame so that they could be easily plucked to provide sound as a result of string vibration. Over time, stringed instruments were mounted on a body or a sounding board with an acoustic chamber to facilitate propagation of the sound generated by plucking or other means of effecting vibration of the strings, for example, by means of a bow as with a violin. During the twentieth century and with the development of acoustic sensitive microphones, a range of electric stringed instruments such as electric guitars has become popular, though acoustic instruments still remain popular.

Instrumentalists who are skilled in the playing of a stringed instrument often are faced with the necessity to contort portions of their body such as their fingers, wrists, arms and the like in order to properly play the stringed instrument. As a consequence, various maladies may be contracted by the instrumentalist such as carpal tunnel syndrome. In order to combat such circumstances, ergonomically designed stringed instruments have been proposed. Various approaches have been suggested with respect to such designs including suggestions incorporated in the following patents:

| Patent No. | Title | Issue Date |
|---|---|---|
| 6,657,112 B1 | Note Bending by Neck Pivoting | Dec. 02, 2003 |
| 6,034,308 | Ergonomic String Instrument | Mar. 07, 2000 |
| 5,852,249 | Elongated String Support for a Stringed Musical Instrument | Dec. 22, 1998 |
| 4,311,078 | Bow Playable Guitar | Jan. 19, 1982 |
| 3,785,239 | Fret Board For Guitar | Jan. 15, 1974 |
| 3,739,072 | Guitar Construction | Jun. 12, 1973 |
| 3,398,623 | Musical Instruments | Aug. 27, 1968 |
| 3,398,622 | Musical Instruments | Aug. 27, 1968 |

Other stringed instrument designs have been suggested to enhance the playability of the instruments such as configuring the instrument in a manner that facilitates playability. Following are some of the patents which could be classified as having such features:

| Patent No. | Title | Issue Date |
|---|---|---|
| 6,573,439 B2 | Ergonomic Multi-Position Guitar with Locking Fingertip Tremolo and Pick Holders | Jun. 03, 2003 |
| 5,994,633 | Stringed Musical Instruments | Nov. 30, 1999 |
| 5,637,820 | Stringed Instrument with On-Board Tuner | Jun. 10, 1997 |
| 5,528,971 | Musical Instrument Having Stabilization Apparatus | Jun. 25, 1996 |
| 4,890,530 | Stringed Musical Instrument | Jan. 02, 1990 |
| 4,339,981 | Soft Body Guitar | Jul. 20, 1982 |
| 4,919,029 | Asymmetric Insert Loaded Stringed Instrument | Apr. 24, 1990 |

-continued

| Patent No. | Title | Issue Date |
|---|---|---|
| D351,181 | Ergonomic Guitar | Oct. 04, 1994 |
| D314,783 | Guitar Body | Feb. 19, 1991 |
| D256,026 | Guitar | Jul. 22, 1980 |

Stringed instruments also have enjoyed the imagination of instrument makers in the context of wide variability in the design of such instruments. Following is a listing of various types of stringed instruments and, in particular, guitars which employ multiple variations in terms of their design:

| Patent | Title | Issue Date |
|---|---|---|
| 6,649,818 | Multiple Neck Integral Body Musical Instrument | Nov. 18, 2003 |
| 3,392,618 | Multirange Fretted Guitar Type Instrument | Mar. 18, 1966 |
| 2,250,402 | Guitar | Aug. 26, 1940 |
| 1,684,467 | Stringed Musical Instrument | Apr. 30, 1923 |
| 1,183,369 | Guitar | May 16, 1916 |
| D964,660 | Stringed Musical Instrument | Jul. 19, 1910 |
| D224,567 | Stringed Musical Instrument | Aug. 01, 1972 |
| D224,566 | Stringed Musical Instrument | Aug. 01, 1972 |
| D222,562 | Stringed Musical Instrument | Nov. 02, 1971 |
| D28,300 | Harp-Guitar Frame | Feb. 15, 1898 |
| 6,667,431 | Stringed Instrument | Dec. 23, 2003 |
| 6,608,247 | Stringed Musical Instrument with Soundbox Extension | Aug. 19, 2003 |
| 5,251,526 | Rotating Electrical Stringed Instrument | Oct. 12, 1993 |
| 4,616,550 | String Support and Neck Device for Stringed Instrument | Oct. 14, 1986 |
| 4,606,255 | Hayashi et al. | Aug. 19, 1986 |
| 3,858,480 | Schneider et al. | Jan. 07, 1975 |
| D812,049 | Musical Instrument | Feb. 06, 1906 |
| D767,023 | Musical Instrument | Aug. 09, 1904 |
| D552,116 | Stringed Musical Instrument | Dec. 31, 1895 |
| D474,120 | Stringed Instrument | May 03, 1892 |
| D417,691 | Electric Guitar | Dec. 14, 1999 |
| D311,413 | Guitar Body | Oct. 16, 1990 |
| D293,118 | Guitar | Dec. 08, 1987 |
| D277,292 | Solid Body Guitar | Jan. 22, 1985 |
| D52,539 | Musical Instrument | Oct. 08, 1918 |
| D45,566 | Musical Instrument | Apr. 07, 1914 |
| D32,088 | Violin Body | Jan. 01, 1900 |
| D26,424 | Mandolin | Dec. 22, 1896 |

While there is a wide variety of designs for stringed instruments including guitars, to address multiple concerns such as playability, comfort, sound quality and the like, there has developed, with the advent of the electric types of instruments, a need for improved ergonomic benefits along with a desire to provide unique designs. With this background, the present invention was conceived.

SUMMARY OF THE INVENTION

Briefly, the present invention comprises a stringed instrument such as a guitar which includes a body, a neck and a fret board or finger board extending from the body, a bridge positioned on the body and a nut assembly at the end of the neck and fret board with strings extending from the body to the nut assembly. The body is uniquely configured and includes at least two, but preferably three generally longitudinal sectors which extend in the direction of the strings and are angled, one with respect to the other. A middle sector supports the bridge and neck. One sector on one side of the middle sector provides a resting surface for the arm of the instrumentalist and another sector on the opposite side of the middle sector provides a lap support for the instrument. The instrument, in the form of a guitar, typically includes lateral side horns incorporated in the side sectors, but may also include a support for a second array of strings connected between a side sector horn and the body.

Thus, it is an object of the invention to provide an ergonomically designed stringed instrument which enhances the comfort and playability of the instrument.

Another object of the invention is to provide a stringed instrument which is capable of having multiple aesthetic designs incorporated therein.

A further object of the invention is to provide an acoustic, stringed instrument, such as a guitar, which enhances playability while simultaneously providing ergonomic benefits.

These and other objects, advantages and features of the invention will be set forth in a detailed description which follows.

BRIEF DESCRIPTION OF THE DRAWING

In the detailed description which follows, reference will be made to the drawing comprised of the following figures:

FIG. 5 is a back side plan view of the instrument of FIG. 1;

FIG. 6 is a left hand end view of the instrument of FIG. 1;

FIG. 7 is a right hand end view of the instrument of FIG. 1;

FIG. 12 is a left hand end view of the instrument of FIG. 8; and

FIG. 13 is a right hand end view of the instrument of FIG. 8.

DESCRIPTION OF THE PREFERRED EMBODIMENT

Figure 1:
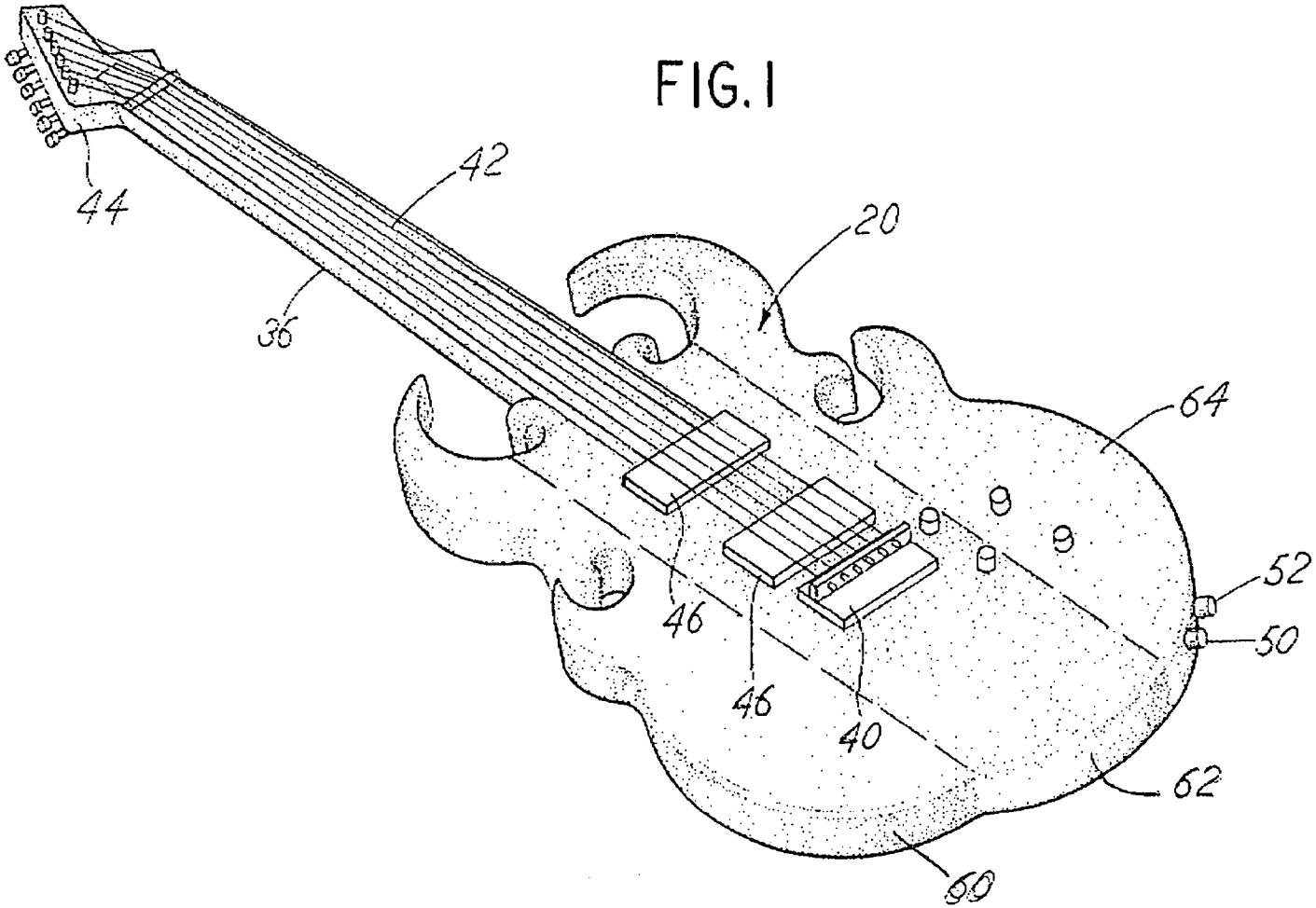
FIG. 1 is an isometric view of a first preferred embodiment of the invention.
Figure 3:
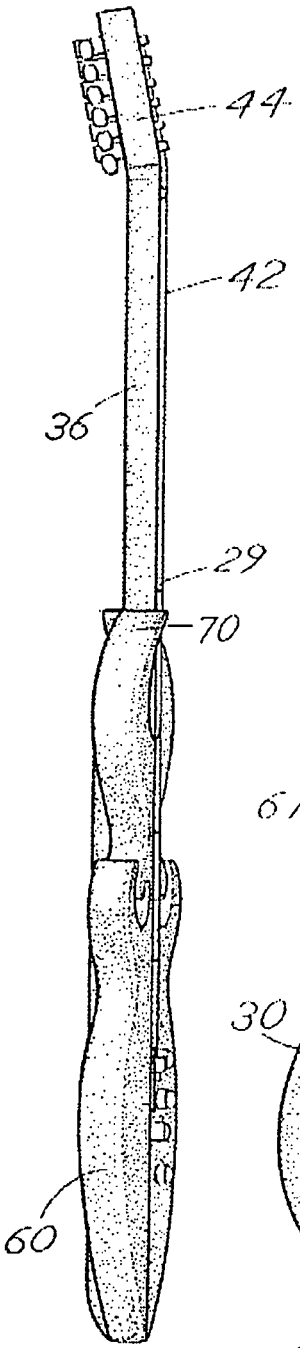
FIG. 3 is a top side plan view of the instrument of FIG. 1.
Figure 2:
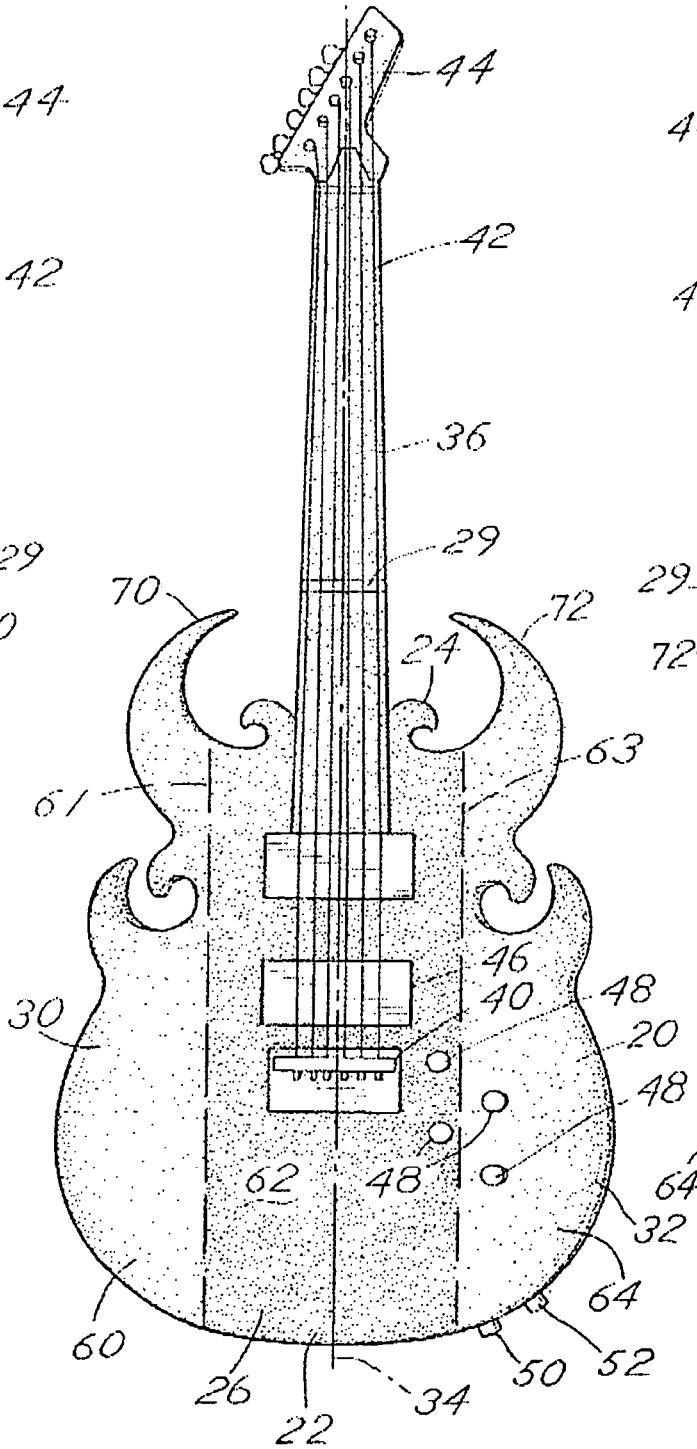
FIG. 2 is a front side plan view of the instrument of FIG. 1.
Figure 4:
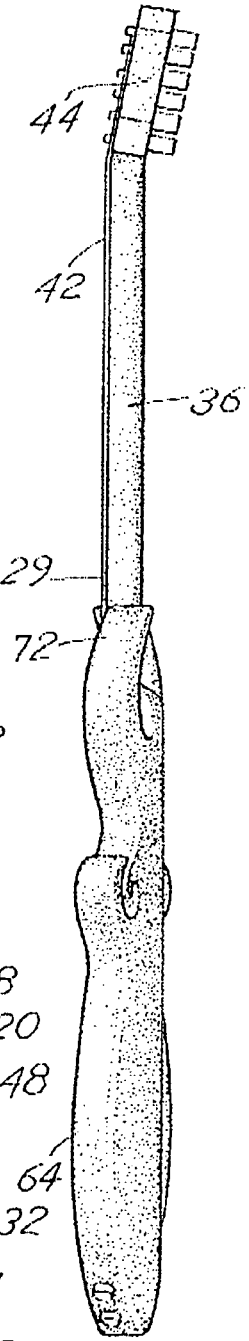
FIG. 4 is a bottom side plan view of the instrument of FIG. 1.

Referring to the figures, and in particular FIGS. 1–7, there is illustrated a first embodiment of the stringed instrument of the invention. The particular embodiment of FIGS. 1–7 is an electric guitar. The guitar includes a body 20 having a lower end 22 or foot end 22, an upper or head end or head stock 24, a front or string side 26 and a back side 28. The body 20 further includes a top side or upper edge 30 and a bottom side or lower edge 32. A longitudinal axis 34 extends between the foot end 22 and head end 24. The design of the body 20 is generally symmetrical with respect to the longitudinal, centerline axis 34 except as described hereinafter. It should be noted, however, that the design of the body 20 need not be symmetrical about the longitudinal axis 34. That is, the configuration of the body 20 on each side of the axis 34 may be distinctive in size and configuration.

The body 20 supports a fret board or finger board or neck 36 projecting generally axially from the body 20 and attached to the body 20. The fret board or finger board 36 includes a series of frets, such as fret 29. A bridge 40 is affixed to the front side or string side 26 of body 20. Strings, such as strings 42, connect from the body 20 over bridge 40 and extend longitudinally along the neck 36 where they are connected to a trim nut or nut assembly 44. Inasmuch as the embodiment of FIG. 1 is an electric guitar, an acoustic pickup, such as pickup 46, is provided within and on the body 20. Controls 48 are associated with the acoustic pickup 46. Connections for the acoustic pickup 46, such as the connections 50 and 52, are also incorporated in the body 20.

The body 20 is generally divided into two and preferably three longitudinal sectors which are generally angled with respect to each other. Thus, the body 20 includes a first sector or upper section 60, a second or middle sector or section 62 and a third or lower sector 64. In a preferred embodiment the sectors 60, 62 and 64 are each generally planar and extend longitudinally generally parallel to the axis 34. The sectors 60, 62 and 64, however, form an angle with respect to one another. That is, the body 20 is typically comprised of generally uniformly thick wood material stock which is formed by combining the three longitudinal sectors 60, 62, 64 connected together along boundaries 61, 63. In particular, the first sector 60 defines a first included obtuse angle 66 with middle sector 62. The angle between the plane of the first sector 60 and the plane of the second sector 62 is typically in the range of about 1 to 45° with the preferred range about 8 to 20° Stated another way, this included obtuse angle between sectors 60 and 62 is in the range of about 135° to 179°.

In a similar fashion, the third sector 64 forms an included obtuse angle with the middle or second sector 62. That angle is generally in the range of the first obtuse angle 66 as described herein. In a preferred embodiment the first and third sectors 60 and 64 are generally planar and generally parallel to one another. Thus, the cross-sectional shape of the body 20 transverse to axis 34 for the embodiment depicted is generally in the form of an S or Z-shape as depicted in FIGS. 6 and 7. Note that the sectors may be curved rather than planar to more clearly define an S shaped cross section. Further, the configuration of a non-planar body may be S or Z shaped on the front or the back face or both faces or sides.

The functionality associated with the shape of the body 20 contemplates that an instrumentalist playing the guitar, if that instrumentalist strums the strings with the right hand, will rest his right arm upon the first or upper sector 60. The lower sector 64 may then be positioned comfortably against the musician's body to facilitate maintaining the instrument in an appropriate orientation for playing. The first sector 60, upon which an arm may rest, enables or facilitates finger comfort and playability of the instrument. Note that the neck and fret board 36 remains generally coplanar with respect to the middle or second sector 62. In other words, the neck and fret board 36 is typically not twisted with respect to the middle sector 62 in the preferred embodiment although it may be angled about longitudinal axis 34 with respect to the second sector 62 in order to further facilitate playability. An alternative embodiment provides for tilting of the fret board 36 and strings 42 rotationally about axis 34.

The middle or second sector 62 comprises the playable area or region of the instrument and the first and third sectors 60, 64 provide a means for orienting and maintaining the orientation of the instrument comfortably. As previously mentioned, the angle of orientation may be adjusted for each individual instrumentalist by altering the angular relationship between the sectors 60, 62, 64. Such differentiation may occur during the manufacturing process, for example, on a customized basis. Such differentiation may be distinct for each sector relative to the next adjacent sector.

In the embodiment of FIG. 1, the instrument includes design characteristics such as the generally longitudinally projecting horns 70 and 72 which are incorporated as part of the first and third sectors 60, 64, respectively. The design features of the guitar may be varied significantly however by providing various alternative aesthetically desired horn or other configurations.

Figure 8:
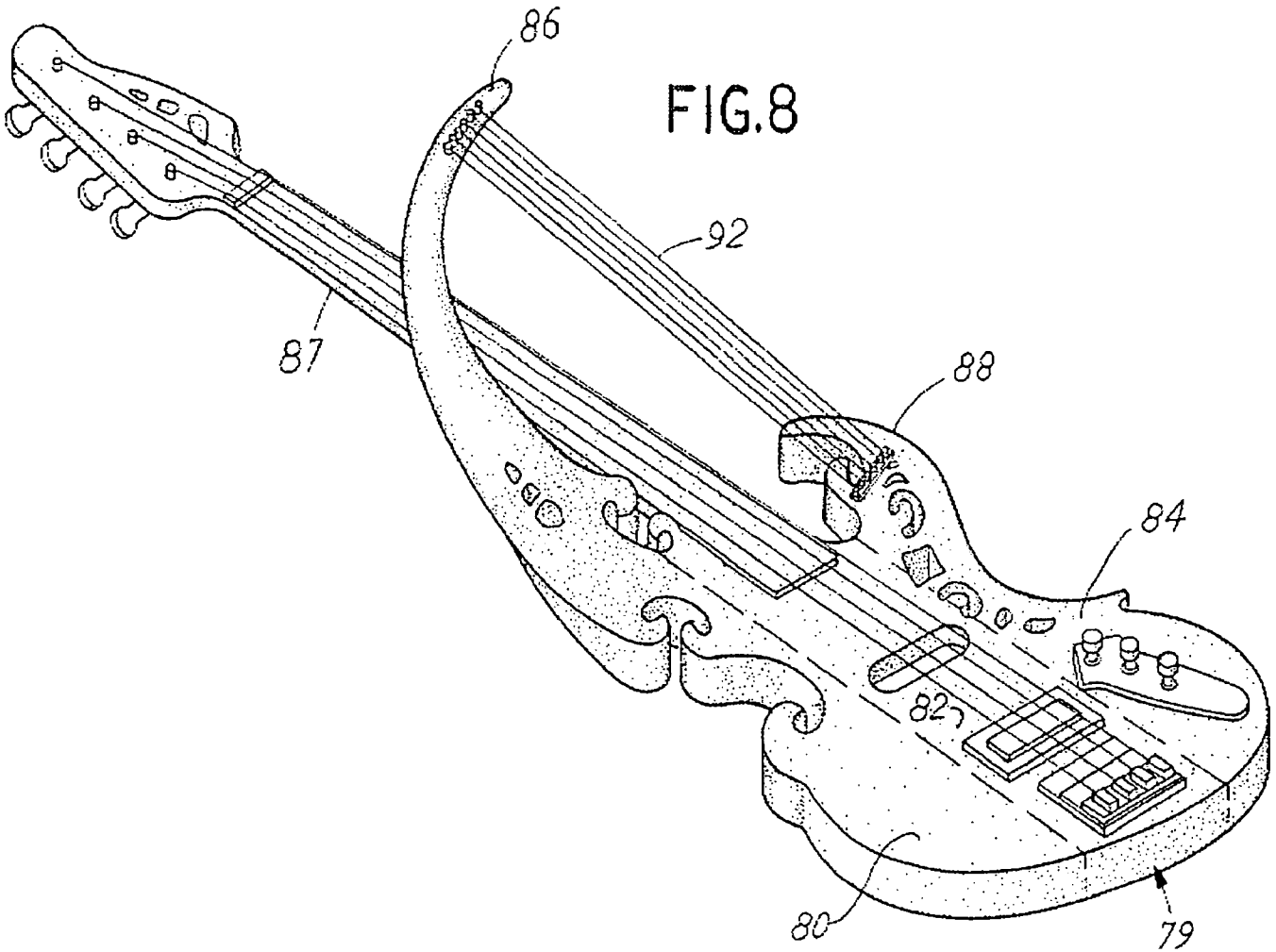
FIG. 8 is an isometric view of a second embodiment of the invention.
Figure 10:
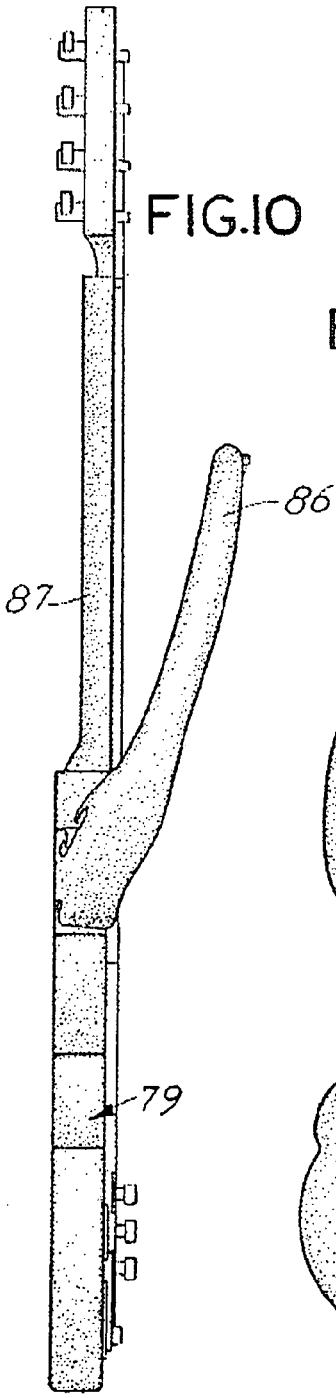
FIG. 10 is a top plan view of the instrument of FIG. 8.
Figure 9:
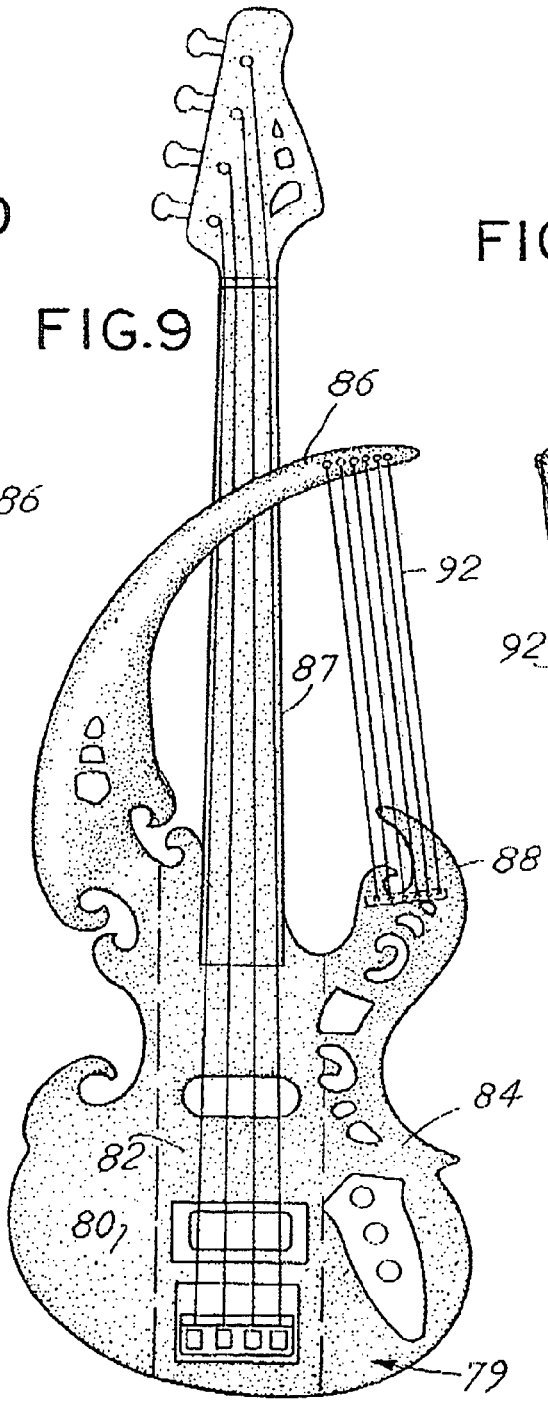
FIG. 9 is a front plan view of the instrument of FIG. 8.
Figure 11:
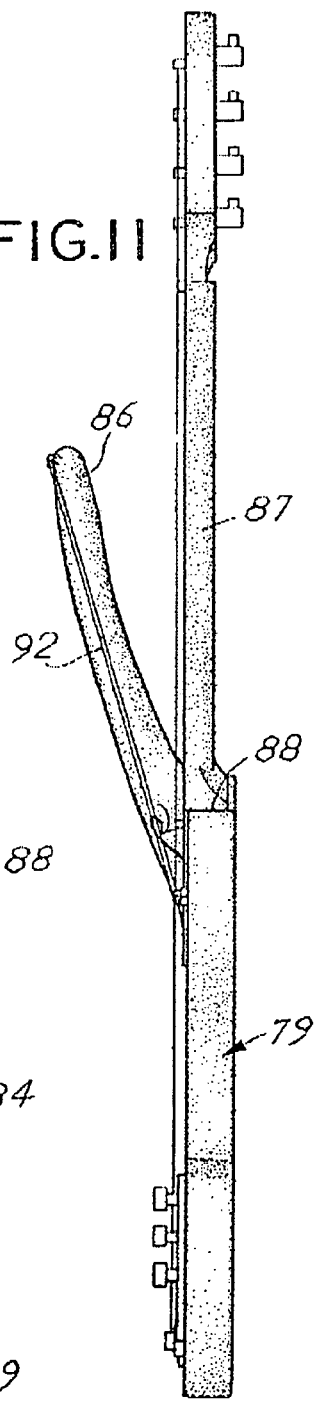
FIG. 11 is a bottom plan view of the instrument of FIG. 8.

FIGS. 8–13 disclose another feature that may be incorporated in such a stringed instrument. In these figures, there is depicted a stringed instrument that does not, but may, incorporate the multiple sector features of the first embodiment. The second embodiment, however, further employs a horn construction which, as depicted in FIG. 8, enables the incorporation of a second set of strings 70. More specifically, a body 79 of the guitar may include a first or top sector 80, a middle or second sector 82, and a bottom or third sector. The sectors 80, 82, 84 may be coplanar or angled as described for the embodiment of FIGS. 1–7. A first sector 80 of the instrument includes a first horn 86 which extends longitudinally and over a fret board 87. A second horn 88 associated with third sector 84 of the body 79 may also extend either over or under the fret board 86 or may be omitted entirely. In any event, a set of strings 92 may be connected between the first horn 86 and the second horn 88. The second set of strings 92 may also be coupled with a fret board (not shown) extending between the third sector 84 over the main fret board 87 and connected to the horn 86. Thus, a dual set of fret boards passing over one another may be incorporated in an embodiment of a guitar to provide an alternative sound which may or may not be amplified depending upon the array and arrangement of the pickups associated with the guitar.

With the design of the invention wherein the body of the guitar is configured ergonomically, it is possible to incorporate wings or horns of multiple designs to provide aesthetic characteristics as well as functional characteristics as described. Further, the instrument may be electric or acoustic with an internal sound chamber. The size and configuration of the sectors may be varied. The instrument may be a six, eight or other multi-stringed instrument.

Thus, it is possible to vary the construction in a configuration of the stringed instrument in a multiple number of ways without departing from the spirit and the scope of the invention. The invention is therefore to be limited only by the following claims and equivalents thereof.

What is claimed is:

1. A guitar comprising, in combination:

a body including a foot end, a head end, a longitudinal axis extending between the foot end and the head end, said body further including a front string side, a back side, an upper side edge and a lower side edge;

said body including at least two longitudinally extending sectors, a first one of said sectors along the upper side edge and a second one of said sectors adjacent the first sector and joined to the first sector;

a neck and fret board extending generally longitudinally from the second sector head end;

a nut assembly on the fret board;

a bridge on the front string side of the second sector aligned generally along the longitudinal axis;

strings mounted over the bridge and fret board and attached between the body and nut assembly;

said first sector defining an arm rest and forming an included obtuse angle in the range of about 135° to 179° with the front string side of the second sector; and at least one horn extending generally longitudinally from the first sector in the direction of the head end and above the plane of the neck and fret board.

2. The guitar of claim 1 wherein said guitar is an electric guitar.

3. The guitar of claim 1 wherein the guitar is a six string guitar.

4. The guitar of claim 1 wherein the body includes a third sector along the lower side edge forming an included obtuse angle with the second sector in the range of about 135° to about 179°.

5. The guitar of claim 4 wherein the first sector and third sector are generally planar and parallel.

6. The guitar of claim 4 wherein the first sector forms an included obtuse angle with the second sector which is opposite an included obtuse angle of the second sector and third sector.

7. The guitar of claim 1 wherein the horn extends over the neck and fret board.

8. The guitar of claim 7 including a second set of strings connected between the horn and body.

9. The guitar of claim 8 wherein the body includes a third sector adjacent the second sector and wherein said second set of strings is attached at one end to the third sector.

10. The guitar of claim 9 including a second fret board extending from the third sector to the horn for the second set of strings.

11. The guitar of claim 1 including a third sector of the body adjacent the second sector.

12. The guitar of claim 11 including a second horn extending generally longitudinally from the third sector.

13. A stringed instrument comprising, in combination:

a body with a head end, a foot end, a generally longitudinal axis between the head end and foot end, said body comprising three joined sectors including a middle sector, a top edge sector joined to the middle sector along a boundary generally aligned with the axis and a bottom edge sector joined to the middle sector along a boundary generally aligned with the axis, said top edge sector separated from the bottom edge sector by said middle sector, said middle sector being generally a flat planar sector;

the cross-sectional configuration of the body transverse to the axis being generally non-linear to provide an ergonomic configuration of the body, said top edge sector forming a first included obtuse angle with said middle sector and said bottom edge sector forming a second included obtuse angle with the middle sector generally opposite the first included angle;

a generally flat planar neck extending from the head end of the middle sector and generally co-planar therewith;

a plurality of strings connected between the neck and the middle sector; and at least one horn extending generally longitudinally from the top edge or bottom edge sector, in the direction of the head end, and above the plane of the neck.

14. The instrument of claim 13 wherein the top edge sector and bottom edge sector form an obtuse angle therebetween.

15. The instrument of claim 13 wherein the top edge sector and bottom edge sector cross-section configuration in combination with the middle sector has a generally Z shape, said top edge sector and bottom edge sector being generally flat planar sectors.

16. The instrument of claim 13 wherein the top edge sector and bottom edge sector cross-section configuration in combination with the middle sector has a generally S shape, said top edge sector and said bottom edge sector each forming a generally uniform curved sector along the axis.

17. The guitar of claim 13 wherein said guitar is an instrument selected from the group consisting of an electric guitar and an acoustic guitar.

18. The guitar of claim 13 wherein the horn extends over the neck.

19. The guitar of claim 13 including a second set of strings connected between the horn and body.

20. The guitar of claim 13 including a second horn extending generally longitudinally from one of said sectors.

21. A guitar comprising, in combination:

a body including a foot end, a head end, a longitudinal axis extending between the foot end and the head end, said body further including a front string side, a back side, an upper side edge and a lower side edge;

said body including at least three longitudinally extending sectors, a first one of said sectors along the upper side edge of said body, a second one of said sectors comprising a middle sector adjacent the first sector and joined to the first sector, and a third lower side edge sector adjacent the second sector;

a neck and fret board extending generally longitudinally from the second sector of the body at the head end;

a nut assembly on the fret board;

strings mounted over the bridge and fret board and attached between the body and nut assembly; and at least one horn extending generally longitudinally from the first sector in the direction of the head end and also above the plane of the neck and fret board.

22. The guitar of claim 21 wherein the first sector and third sector are generally planar and parallel.

23. The guitar of claim 21 wherein the third sector forms an included obtuse angle with the second sector and the first sector forms an included obtuse angle with the second sector which is opposite said included obtuse angle of the second sector and third sector.

24. The guitar of claim 21 including a second set of strings connected between the horn and body.

* * * * *